United States Patent [19]

Shoemaker, Jr.

[11] Patent Number: 4,718,667

[45] Date of Patent: Jan. 12, 1988

[54] AMUSEMENT DEVICE

[76] Inventor: Stephen P. Shoemaker, Jr., 123 International Boardwalk, Redondo Beach, Calif. 90277

[21] Appl. No.: 791,687

[22] Filed: Oct. 28, 1985

[51] Int. Cl.[4] ..... A63F 9/00

[52] U.S. Cl. ..... 273/1 GC; 273/1 GG; 212/214

[58] Field of Search ..... 273/1 GC, 1 GG, 138 A, 273/1 E, 148 B; 33/1 M; 212/214, 271; 221/210

[56] References Cited

U.S. PATENT DOCUMENTS

| | | | |
|---|---|---|---|
| 1,878,894 | 9/1932 | Sallee | 221/210 |
| 1,927,877 | 9/1933 | Meyer | 221/210 |
| 1,938,834 | 12/1933 | Graf | 221/210 |
| 2,600,849 | 6/1952 | Collins et al. | 221/210 X |
| 2,743,024 | 4/1956 | Schmitt et al. | 212/214 |
| 3,572,703 | 3/1971 | Greene | 273/1 GC |
| 3,764,900 | 10/1973 | Baldwin | 33/1 M X |
| 4,246,452 | 1/1981 | Chandler | 273/148 B X |
| 4,272,649 | 6/1981 | Pfeiffer | 273/1 E X |
| 4,369,579 | 1/1983 | Mizoule | 33/1 M |
| 4,408,103 | 10/1983 | Smith, III | 273/148 B X |
| 4,550,503 | 11/1985 | Klawitter | 33/1 M X |
| 4,600,083 | 7/1986 | Parent et al. | 33/1 M X |

FOREIGN PATENT DOCUMENTS

| | | | |
|---|---|---|---|
| 685361 | 3/1965 | Italy | 273/1 GG |

OTHER PUBLICATIONS

Popular Science 6-1984 p. 14.

*Primary Examiner*—Paul E. Shapiro
*Attorney, Agent, or Firm*—Brown, Martin, Haller & Meador

[57] ABSTRACT

An amusement device in which a player controls positioning of a mechanical pick-up device such as a claw having pincers or fingers which can be closed over an object to be retrieved. The grasping claw is positioned within a housing on the floor of which various objects are placed for retrieval by players. The claw is attached to an overhead transport mechanism which is driven by various external controls to position the claw anywhere in the housing. Once a chosen position over an object is reached the claw is lowered automatically and can be stopped and closed by the player in an attempt to grasp the object. when the claw is closed it is automatically raised back to its uppermost position and returned to a home position over a chute for delivering any retrieved object to the player.

24 Claims, 8 Drawing Figures

AMUSEMENT DEVICE

BACKGROUND OF THE INVENTION

The present invention relates to amusement devices of the so-called "claw machine" or crane type in which objects within a closed housing can be retrieved by players by means of a pronged claw or other pick up device attached to a transport mechanism which moves the claw fack and forth and up and down over the objects. the claw is closed after lowering it to the level of the objects in an attempt to grasp and retrieve one of the objects, and then returned to a home position in which any retrieved object can be delivered to the player.

Claw machine amusement devices have up to now involved only a relatively low degree of skill on the part of the player, since the player had only limited control over the positioning of the claw. The element of chance involved in retrieving an object, or "winning a prize" would discourage players who felt that they did not have a fair change to win, and also caused many such devices to be illegal in states prohibiting gambling, since any game involving a payoff must involve a relatively high degree of skill on the part of the player to be legal in many states. Generally, in such machines a pronged claw or shovel is attached to an overhead boom or crane arm by a nylon or metal chain. On the outside of the machine is a lever, wheel, or other control mechanism by which the player may direct the movement of the boom and claw for a predetermined allowed time interval. During this time the claw swings freely on its chain. The player controls both the direction in which the boom travels and the distance the claw will fall by lowering the boom.

In some such machines the control wheel or lever is operable only prior to movement of the boom, and thus msut be preset by the player, after which he exercises no further control. In other machines a player may choose either the preset method or a control method in which the control wheel may be used to alter the direction and distance the claw travels while it is in motion. In either case, once the alloted time has expired the claw will drop, the prongs of the claw will close, and the boom then withdraws to its starting position.

Thus the player may be able to exercise some degree of skill in controlling the general location of the claw on lowering to the level of the objects, but has no control over the actual closing of the claw. The claw may swing as it goes down so that it is not optimally positioned when it reaches the lowermost position. Even if it is optimally positioned, it may not grasp an article sought when it closes, or a gasped article may slip out of the claw due to the swinging of the claw as the boom returns it to its starting position.

Another problem with the known type of claw machines is that the transport mechanism is primarily switch operated, and any switch failure could cause a drive motor to idle until it burns out. The abrupt cut-off on turn off of a switch causes further swinging of the claw which reduces the chances of correct positioning of the claw and increases the risk that a picked up prize may be dropped, to the annoyance of a player who will be unlikely to risk a repeat of the experience. In some cases the transport mechanism is so bulky that it is unable to cover the entire floor area over which prizes are distributed, contributing to the risk of failure.

SUMMARY OF THE INVENTION

According to the present invention an amusement device is provided which comprises a housing having a floor over which prize items can be distributed, a pick-up device within the housing for picking up items from the floor, and a transport mechanism on which the pickup device is mounted for transporting the pick up device to any chosen location in the housing. The transport mechanism includes a horizontal transport for transporting the pick up device in a horizontal plane above the entire floor or play area of the housing, and a vertical transport for moving the pick up device vertically up and down between a raised position and a lowered position generally level with items on the floor of the housing. The housing includes a delivery chute for delivering picked up items to a player, and the transport mechanism is arranged to return to a start position above the delivery chute after each attempted prize retrieval.

A control mechanism for controlling operation of the transport mechanism includes an external control device for operation by a player to control both the horizontal and vertical transport to transport the pickup device to a chosen horizontal and vertical location. The external control device preferably also includes control of actuation of the pick-up device to attempt to pick up an article once a chosen position has been reached. The control mechanism in the preferred embodiment of the invention is arranged to return the pick up device automatically to the start position and end the game once the pick-up device is actuated.

The external controls of the control mechanism may include a speed control for controlling the speed at which the pick-up device is transported, and a stop control for controlling the vertical position at which the pick-up device stops. Preferably, a timer is provided for controlling the period of time over which a player has control of the transport mechanism, which will be sufficient to allow travel from the start position to any position in the housing.

Since the player has full control over the positioning of the pick-up device prior to the pick-up attempt, a high degree of skill will be involved in manipulation of the controls in order to correctly position the pick-up device and the more skillful player will be the most successful in retrieving prize items. Thus there will be a greater degree of player satisfaction in operation of the device, and the device will be primarily a game of skill rather than primarily a game of chance as was the case in many previous amusement devices of this type.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
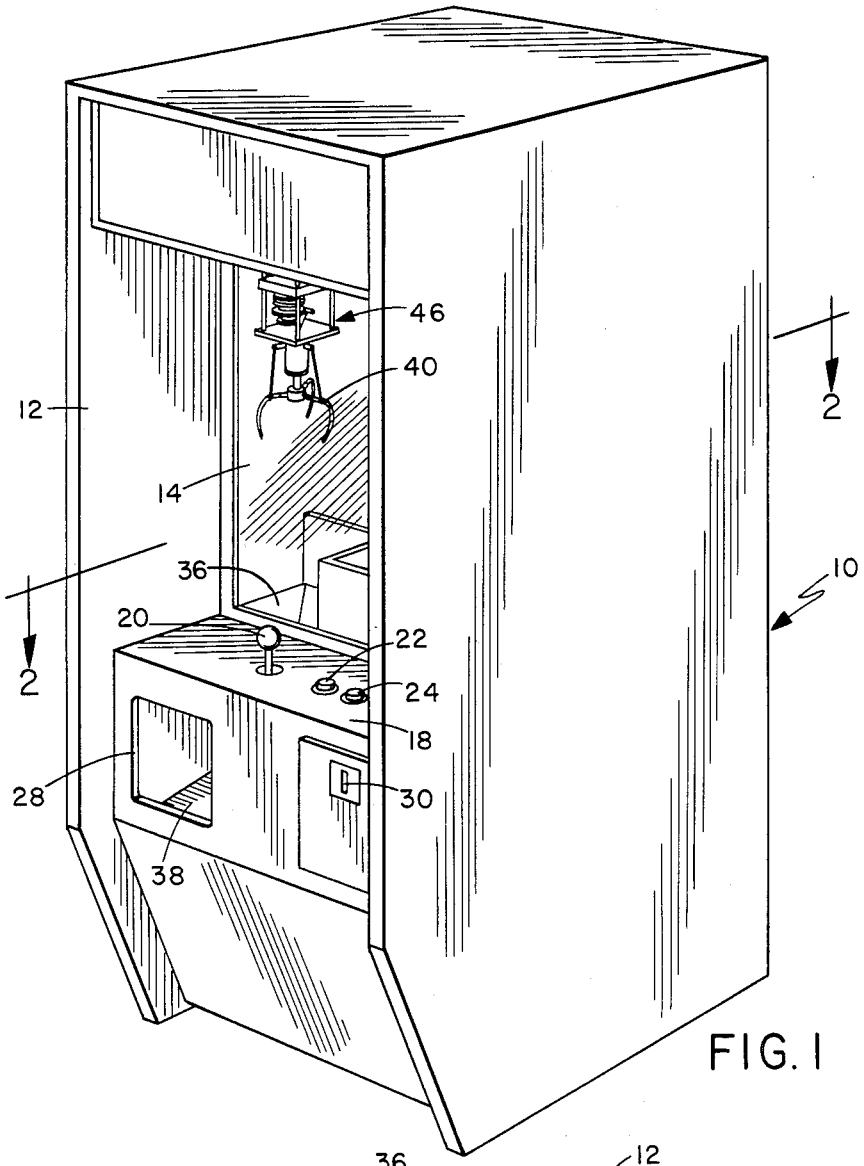
FIG. 1 is a perspective view of one configuration of a complete amusement device or unit according to a preferred embodiment of the invention.
Figure 2:
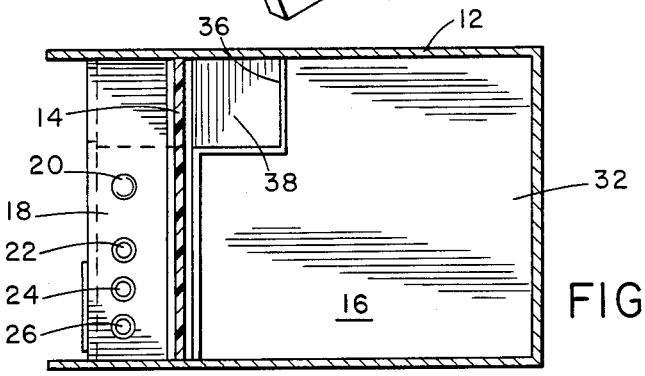
FIG. 2 is a sectional view taken on the line 2—2 of FIG. 1.

The drawings show a preferred embodiment of an amusement device according to the present invention. As shown in FIGS. 1 and 2, the amusement device 10 comprises an upright exterior housing or cabinet 12 the upper part of which has a transparent front window 14 through which a player or operator can view the interior playing area 16. The height of the cabinet is chosen according to the average player height so that the device can conveniently and comfortably be operated from a standing position.

An external player control panel 18 is provided on the front of the housing below the viewing window 14, the panel including a directional control lever 20 and three control buttons 22,24 and 26, the purpose of which is described in more detail below. A prize delivery opening 28 is located below the play area, and a coin slot 30 for a player to deposit a coin or token to initiate a game is located below the control panel 18. The coin slot is connected to a standard con discriminating device (not shown) for determining if the correct denomination of coin has been deposited and for initiating a game if the coin is validated.

The interior of the housing is divided into an upper playing area and a separate lower area by a transverse floor or wall 32 which constitutes the floor of the playing area over which suitable prizes such as soft toys and the like can be distributed. In the front left hand corner of the floor an opening 36 is provided which communicates with a chute 38 for delivering prizes to the delivery opening 28 on the front of the housing.

A suitable pick-up or claw device 40 for operation by players in attempting to retrieve prizes is mounted on an overhead transport mechanism in the playing area above the floor 32. The pick-up device and transport mechanism are best shown in FIGS. 3 to 6. the device 40 in the preferred embodiment of the invention is of the claw type, having three or more prongs 42 movable between the open position shown in FIG. 4 and the closed or grasping position shown in FIG. 6. However other types of pick-up devices may be used, such as shovels or hooks, for example.

Figure 3:
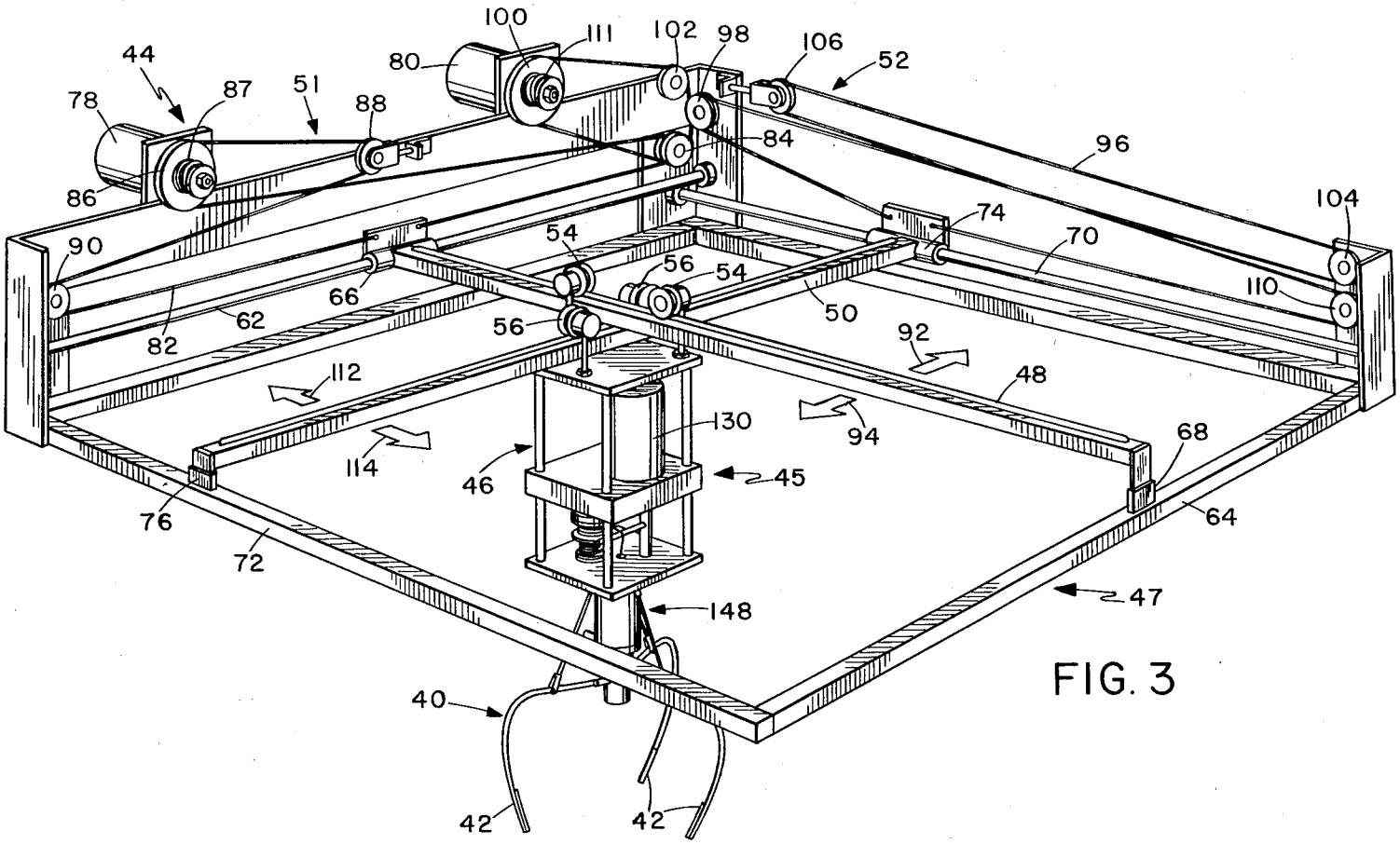
FIG. 3 is a perspective view of the claw positioning and actuating mechanism.
Figure 7:
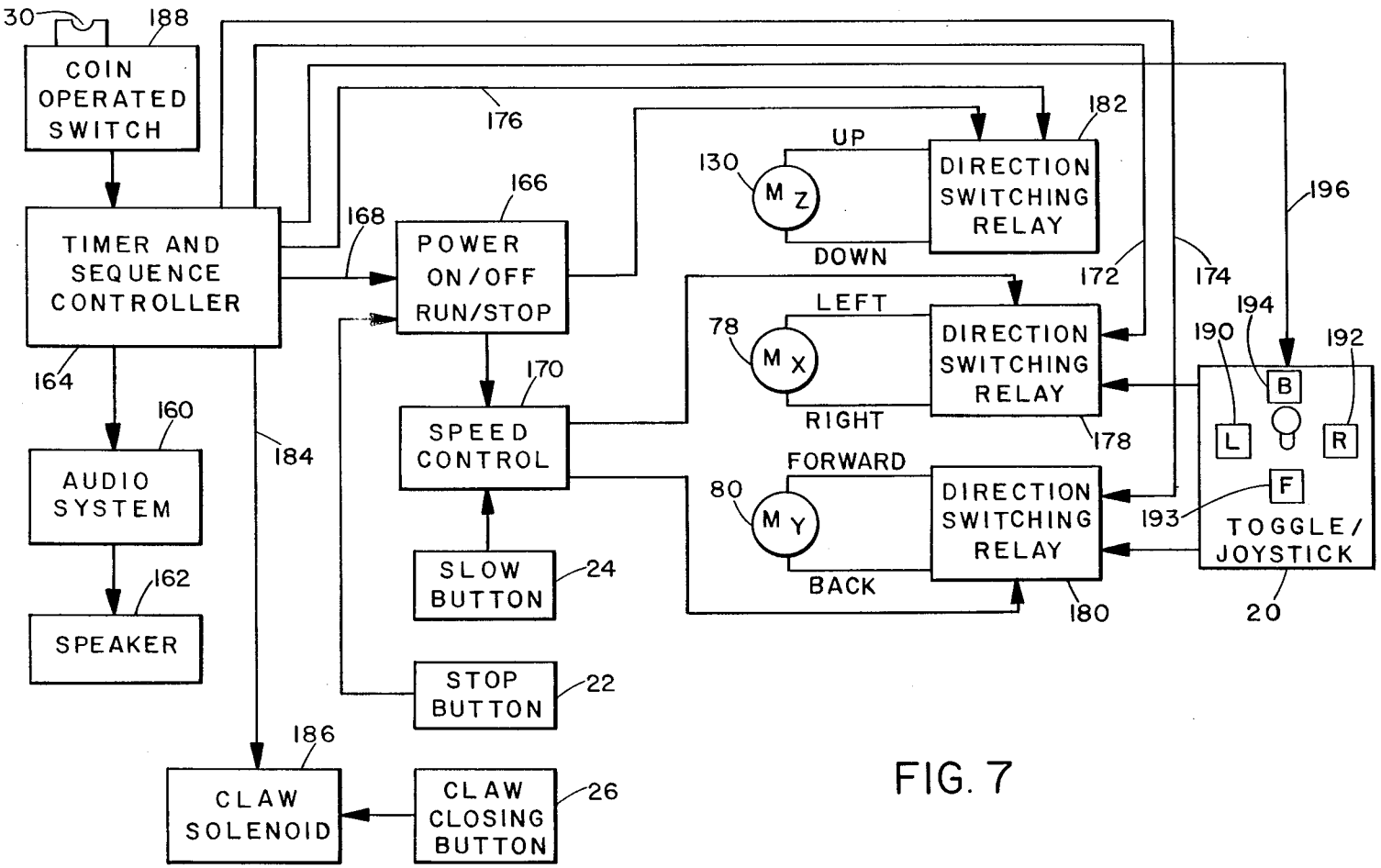
FIG. 7 is a block diagram of the game control system.

The transport or claw positioning mechanism is shown in detail in FIG. 3 and is designed to move the pick-up device horizontally and vertically to any chosen position in the playing area 16 under the control of a control circuit, shown in general block diagram form in FIG. 7, through which the player control panel is connected to the transport mechanism to allow the player a large degree of control over the operation of the transport mechanism. The transport mechanism includes a horizontal transport assembly 44 for transporting the pick-up device in a horizontal X-Y plane over the playing floor to any chosen overhead position, and a vertical transport assembly 45 for moving the pick-up device or claw in the vertical or Z direction between a raised, retracted position and a lowered position at the level of prizes on the playing floor.

The claw device 40 is mounted on an overhead carriage 46 which is transported via horizontal transport mechanism 44 in a horizontal plane over the entire playing floor area. The horizontal transport mechanism is best shown in FIG. 3 and basically comprises a fixed square frame 47 extending around the top of the playing area on which transverse moving rails 48 and 50 are slidably mounted to extend perpendicular to one another in a horizontal plane above the playing floor. The rails 48 and 50 are driven via motor driven pulley assemblies 51 and 52, respectively, for movement between the front and rear wall (Y direction) and between the side walls (X direction), respectively, of the playing area. The pulley assemblies and associated reversible drive motors are mounted on the square frame above the plane of the moving rails 48 and 50 so as to extend across the inner face of the front and one side wall of the housing, and will normally be hidden from the player's view.

The moving rails cross each other with the rail 48 extending above the rail 50. The carriage is supported on the two moving rails at the cross over point via two sets of rollers or wheels 54, 56 which run respectively in the upper and lower moving rail 48, 50 as shown in FIG. 3. Each set of rollers is secured to the upper end of the carriage via pairs of connecting rods 58, 60, respectively. Each pair 58, 60 of connecting rods is positioned on opposite sides of the respective moving rail 48, 50, respectively, so that the rail passes between the respective roller connecting rods as shown in FIG. 3.

The upper moving rail 48 extends between the opposite front and rear walls of the housing where it is slidably mounted on a fixed rod 62 at one end and a fixed rail 64 at the opposite end, which extend along two opposite sides of the square frame. The rail 48 is secured at one end to a tube or sleeve 66 which slides on the rod 62, and has a roller or slide pad 68 at the opposite end which runs along the fixed rail 64. Similarly, the other moving rail 50 extends between the opposite side walls of the housing where it is slidably mounted on a fixed rod 70 at one end and a fixed fail 72 at the other end, the rod and rail extending along the other two opposite sides of the square frame. The rail 50 is secured at one end to the sleeve 74 which slides on rod 70, and at the other end to the pad 76 which slides on rail 72.

Thus the rod 48 is movable in opposite directions as indicated by the arrows in FIG. 3 between the opposite side walls of the housing, carrying the carriage 46 with it as the rollers 56 slide along the rod 50. Similarly the rod 50 is movable in opposite directions transverse to the movement of rod 48 between the opposite front and rear walls of the housing, varrying the carriage with it as the rollers 54 slide along rod 48. Simultaneous movement of both rods therefore results in a panning type movement of the pick up device 40 which covers the entire playing floor area.

The rods 48 and 50 are driven in their respective directions by the respective reversible X and Y direction drive motors 78 and 80 via the pulley assemblies 51 and 52. The pulley assemblies are operatively connected to the respective motors via slipping clutches. Operation of the drive motors 78 and 80 is controlled by the circuit shown in FIG. 7, as described in more detail below. A first pulley wire 82 is connected at opposite ends to opposite ends of the sleeve 66 and extends around the various rollers of the pulley assembly 51. The wire extends from one end of the sleev around roller 84 to the motor driven roller 86 which is connected to the motor by slipping clutch 87, and then passes around tensioner 88 and roller 90 to connect to the opposite end of the sleeve 66. Thus operation of the motor 78 in forward will pull the sleeve 66, and thus the rod 48 and carriage 46, in the direction of the arrow 92 in FIG. 3. Similarly, operation of the motor 78 in reverse will pull the rod 48 in the opposite direction 94.

A second pulley wire or line 96 is connected at opposite ends to the sleeve 74 and extends around the various rollers of the pulley assembly 52, which includes a 90 degree turn at the front right hand corner of the housing so that both motors can be mounted inside the front wall of the housing. The wire 96 extends around roller 98, roller 84 (which also forms part of the first pulley assembly), to motor driven roller 100 and then passes back around roller 102 to roller 98, around roller 104 and tensioner 106, and around roller 110 before being connected to the opposite end of sleeve 74. Motor driven roller 100 is operatively connected to the motor 80 via slipping clutch 111. Thus operation of the motor 80 in forward and reverse will move the rod 50, and thus the carriage 44, in the opposite Y directions indicated by the arrows 112 and 114 between the front and rear walls of the housing.

Clearly simultaneously operation of both motors 78 and 80 will drive the cross over point of the rods 48 and 50, and thus the carriage and pick-up device carried at the cross over point, in a direction determined by the speed and direction of each motor. The direction of travel of the carriage is controlled by the player during a game sequence via the control lever or joystick 20 which can command the carriage to travel in any one of eight vectors, i.e. left, right, forward, back and along any one of the four diagonals. The left and right directions correspond to motor 78 being on while motor 80 is off, and vice versa for the forward and back directions, while the diagonal directions involve both motors being on in any of the four possible combinations of forward and reverse. This is described in more detail below in connection with the game control system shown diagrammatically in FIG. 7.

The slipping clutches 87 and 111 ensure that the carriage travels relatively smoothly even when it reaches the limits of travel in the x and y directions, since there will be no abrupt switching off of the respective x and y direction motors.

Figure 4:
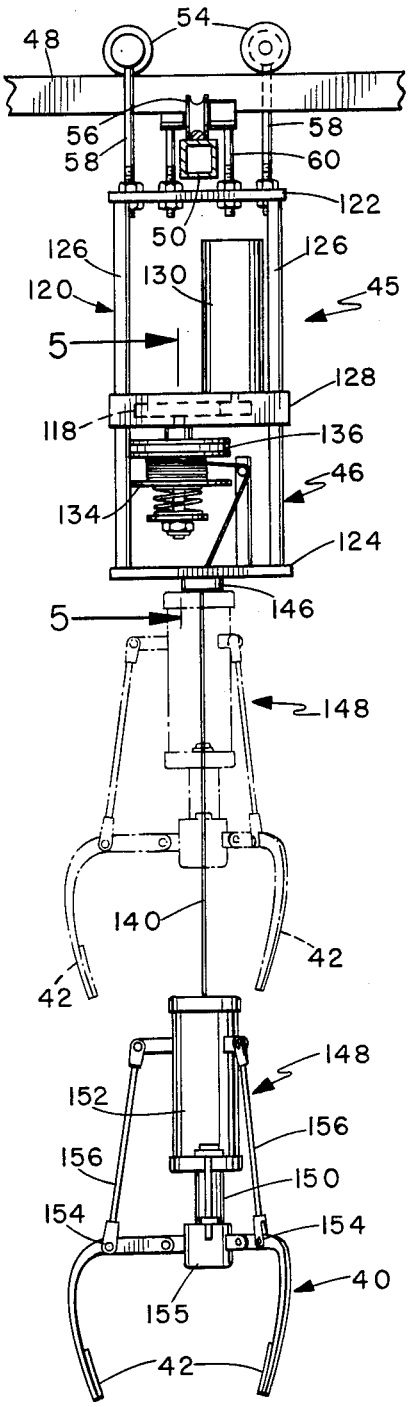
FIG. 4 is an enlarged side elevation view of the claw and its actuating mechanism.
Figure 5:
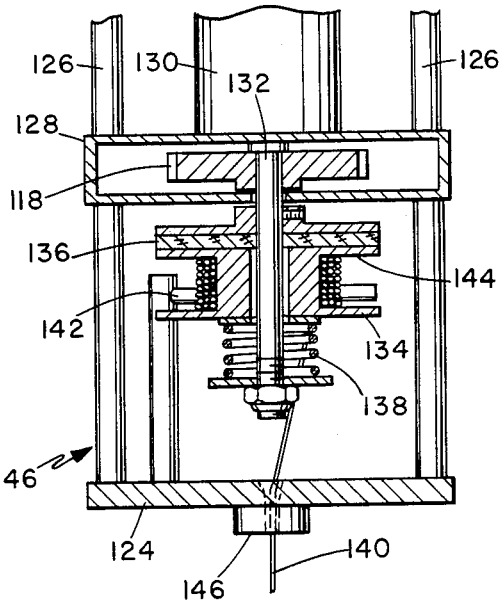
FIG. 5 is an enlarged sectional view taken on the line 5—5 of FIG. 4.
Figure 6:
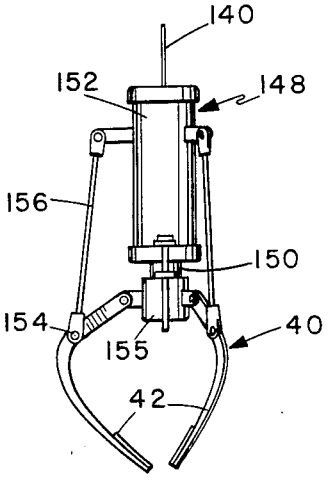
FIG. 6 is a side elevation view of the claw in a closed position.

The claw device 40 is movable vertically relative to the carriage 46 between the raised or retracted position shown in dotted outline in FIG. 4 and any chosen lowered position as indicated in solid outline in FIG. 4. Vertical or Z direction movement of the claw device is controlled by the vertical transport mechanism 45 which is mounted on the carriage 44 as best shown in FIGS. 4 and 5.

The carriage basically comprises an outer frame 120 having upper and lower plates 122 and 124 spaced apart by square frame spacer rods 126, and an intermediate hollow plate member 128 spaced between the upper and lower plates. The vertical transport mechanism comprises a motor 130 mounted on the intermediate member 128 to operate a drive shaft 132 via gear wheels 118 mounted within the intermediate member 128. A pulley 134 is connected via slipping clutch 136 to the drive shaft 132. The pulley is urged against the clutch 136 by a spring 138, as best seen in FIG. 5, and the clutch is secured to the driven shaft 132 so that rotation of shaft 132 will be transmitted to the pulley.

The claw device 40 is suspended from the carriage via a chain or cable 140 which extends from the device 40 through an opening in the lower plate 124 and around a guide 142 before wrapping around an annular groove 144 of suitable depth in pulley 134. Operation of the motor 130 in forward and reverse will thus cause the cable 140 to unwind and wind up, respectively, on the pulley 134 to either lower the claw device from the carriage as shown in solid outline in FIG. 4, or to raise it to the raised, retracted position shown in dotted outline in FIG. 4, where it is held firmly against a stop or seat 146 on the lower plate of the carriage. When the claw device is fully raised, the motor 130 will still continue to operate for a predetermined time period, causing the clutch 136 to slip and ensuring that there is little or no rebound of the claw device on hitting seat 146. The claw device is thus positively held against the seat 146 when raised. Operation of the motor 130 is controlled by the control system as described in more detail below in connection with FIG. 7.

The claw device itself comprises the three prongs 42 as mentioned above, and a claw actuating mechanism 148 for controlling opening and closing of the claws. The prongs 42 are each pivotally mounted at their upper ends on a solenoid operated plunger 150 which is controlled by a solenoid within housing 152. Each prong is pivotally connected at an intermediate point 154 in its length to a respective lever arm 156 pivotally mounted at its opposite end on the upper end of the housing 152. Thus, retraction of the plunger 150 into the housing on actuation of the solenoid will cause the prongs 42 to pivot inwardly about the points 154 into the closed position shown in FIG. 6, and subsequent release of the plunger will cause it to drop under the action of weight 155 into the extended position shown in FIG. 4, causing the prongs to pivot in the opposite direction into the open position shown in FIG. 4. Operation of the plunger to open and close the claws or prongs 42 is also controlled by the game control system, as will be described in more detail below.

FIG. 7 illustrates in block diagram the game control system for controlling operation of the three position controlling motors and the claw actuation solenoid. The control system also controls operation of an audio system 60 connected to a loudspeaker 162 in the game housing to generate a "sound track" to accompany the game which reflects the moment-by-moment status of the game sequence.

The game control system is preferably constructed on a single printed circuit board contained within the game cabinet. A game timer and sequence controller 164 is suitably programmed to control play of a game according to a predetermined game sequence so that the playing procedure is consistent from game to game. The game sequence is shown in block diagram in FIG. 8.

The timer and sequence controller initiates a "power-up-reset" procedure each time power is turned on to the device. This sequence performs a self-test of the system and ensures that the carriage and suspended pick-up device is positioned in the home position at the left and forward corner of the play area. This is the normal starting position for play.

The timer and sequence controller controls the supply of power 166 to the three drive motors 78, 80 and 130 controlling movement of the claw device in the X,Y and Z directions, respectively, along line 168. Power is applied directly to the Z direction motor 130 and via a speed control 170 to the X and Y direction motors which controls the speed at which the motors operate. This is preferably in the form of a variable voltage source or potentiometer in which the resistance is varied to vary the drive voltage supplied to the drive motors 78 and 80.

The time and sequence controller also controls the direction of each of the drive motors along lines 172, 174 and 176. The controller communicates with switching relays 178, 180 and 182 which are used to reverse the direction of travel of the associated motor by reversing the polarity of the applied DC drive voltage.

Finally, the controller 174 communicates along line 184 with the claw solenoid 186 to control actuation of the solenoid to close the claw prongs.

The various controls provided on the player control panel are also connected to various points in the control system circuit as indicated in FIG. 7. The direction control lever or joystick 20 is connected to the X and Y direction motor switching relays, the stop button 22 is connected to control the supply of power to the Z motor 130, the slow button 24 is connected to speed control 170, and the claw button 26 is connected to claw solenoid 186. The timer and sequence controller is arranged to control the times at which the various player controls are enabled, as described in more detail below.

An actual game sequence will now be described with reference to FIGS. 7 and 8 so that the control system operation can be better understood.

When a player wishes to initiate a game, the predetermined coin or other token must first be entered via slot 30. If the coin is a valid one, a switch 188 will be operated to intiiate a RESET signal to the controller 164, initiating a predetermined game sequence. The sequence starts with a characteristic sound output produced by the audio system 160 over the loudspeaker 162. At the same time suitable control signals will be provided according to program instructions by the controller 164 to supply drive voltage to the X and Y direction motors and to control the switching relays so as to cause the carriage and claw 40 to jump a short distance to the right and to the rear of the playing area, as viewed from the front of the housing 12. The sound and motion is designed to alert the player that the game sequence has begun.

At this point the controller 160 initiates a "joystick enabled" period of play during which the control lever or joystick 20 controls the carriage 46 to travel in a chosen horizontal direction. This period may be any chosen time programmed into the timer and sequence controller, but will generally be of the order of 9 seconds or longer to allow sufficient time to move the carriage to a chosen horizontal location in the play area. In the preferred embodiment of the invention the joystick enabled period is pre-adjustable by the operator to any chosen time period between 5 and 11 seconds. The sound system is arranged to provide the player with audio feedback during the "joystick enabled" period, which indicates the time remaining to position the carriage. The output tone or melody increases in both pitch and tempo as time progresses, culminating in a high pitched tone which signals the end of the joystick enabled period, at which point power to the X and Y direction motors is cut off. With experience the player will come to recognize the sound effects and associate them with the probable time remaining to position the carriage horizontally.

The control lever or joystick 20 consists of four switches 190,192,193 and 194 wired with a common enable signal 196 from the controller 164. The four switches correspond to movement of the carriage in the left, right, forward and rear directions, respectively.

When the player stands in front of the control panel facing the play area and pushes the lever to his left, the switch 190 is closed to control the switching relay 178 to control the drive voltage polarity supplied to the X direction motor 78 to move the carriage towards the left wall of the housing. Similary, movement of the lever to the right closes switch 192, reversing the polarity of the voltage to drive motor 78 in reverse and move the carriage to the right, and movement of the lever forwards and rearwards controls closing of switches 193 and 194 to supply opposite polarity drive voltages to the motor 80 and thus move the carriage towards and away from the front of the housing. Diagonal movements of the lever will close one of the X direction and one of the Y direction switches simultaneously, causing the carriage to move along the corresponding diagonal. Thus the player may direct the positioning of the carriage in a horizontal plane in any of eight directions during the "joystick enabled" period.

The speed of travel of the carriage in this period may be selected by the player between two preset rates by means of the "SLOW" control button 24. The normal or faster rate is automatically selected unless the "SLOW" button is pressed, which slows the rate of travel significantly by means of the speed control or speed adjustment potentiometer 170 which controls the voltage applied to the two motors 78 and 80. Both the normal and slow rates may be preset and adjusted by the owner/operator of the device by adjusting the potentiometer.

While the carriage is travelling in a horizontal plane the claw device will be held fast in the retracted position against the stop on the carriage or crane, so that there will be no swinging movement of the claw device and the player is better able to estimate when the claw is correctly positioned over the chosen prize. The slow button allows the positioning to be finely adjusted by the player once the chosen position approaches.

Once the player has moved the carriage to the chosen overhead position and the "joystick enabled" period has ended, there will be a short pause after which the controller 160 operates the vertical control mechanism automatically to start moving the claw device towards the floor of the housing. Thus the controller controls both the supply of power to the motor 130 and the positioning of the switching relay 182 to drive the motor in a direction which unwinds the claw cable or chain from the pulley 134.

During the descent period, power to the horizontal transport mechanism is switched off so that the player no longer has control of the X/Y positioning of the claw. The player can control the rate of descent of the claw by pressing the STOP button 22, which arrests movement of the claw while the button is pressed, with the claw resuming its downward travel once the button is released. At any chosen time the player may press the CLAW button 26, which actuates solenoid 186 to close the claws or prongs. Any prize lying within the claws at this point is likely to be grasped or clamped between the claws.

The period of time allowed for claw descent and actuation is limited to a predetermined length of time under the control of timer 160. At the end of the alloted time period the controller will automatically actuate the claw to close if the player has not already done so. The time period continues to run even while the player is pressing the STOP button. The running of the allowed descent period is also indicated to the player by means of an appropriate sound sequence or track from the sound system, which is preferably a melodic descent of the sound scale which continues to be heard even while the stop button is depressed.

In the preferred embodiment of the invention, the SLOW button is only operative to decrease the horizontal speed of movement of the claw device, while the STOP button is only effective to stop the descent of the claw device and does not stop the horizontal panning of the carriage during the "joystick enabled" period. The two buttons may be wired in parallel in the preferred embodiment of the invention so that pressing either button during the joystick enabled period will reduce the speed and pressing either button during the descent of the claw will stop the descent.

The gripping action of the claw is immediately announced by a characteristic sound from the sound system, irrespective of whether it was initiated automatically by the controller or by the player depressing the CLAW button. Once the claw has been closed the player has no further control over the transport mechanism and an automatic return sequence is initiated by the controller.

During the return sequence the controller actuates the vertical control motor 130 to wind the cable onto the pulley 134 until the claw device reaches the limit of upward travel and is held firmly against the stop. The device then pauses briefly, and the controller then actuates the horizontal transport mechanism to transport the carriage in a left, forward direction until the home position above the prize delivery chute is reached. This is preferably done by controlling each motor to run for a time period sufficient to move the carriage from the opposite walls of the housing, with the slipping clutches 87 and 111 ensuring that the carriage travels smoothly when the left side or forward wall is reached. During this period the claw is held against the carriage by operation of the slipping clutch and maintained in a closed condition.

The game sequence concludes by the controller releasing the claw controlling solenoid to open the claw device so that any prize picked up by the player will be delivered via the delivery chute. Distinctive sound patterns will also be provided by the sound system during travel to the home position and opening of the claw.

If a player should insert a coin during a game sequence, a new game sequence will be initiated. If a coin is inserted during the "joystick enabled" period of horizontal movement, the game will begin anew from the current position of the carriage, beginning with the characteristic tone and the short jump to the right, rear direction to indicate that a new sequence is starting. If a coin is inserted during the descent or ascent periods of the claw device, the game sequence will begin anew once the claw device has reached its upper limit of travel, irrespective of the player's success in gripping a prize. If a coin is inserted during horizontal travel towards the home position, the claw device will immediately open and the game will restart from the current position of the carriage. In all cases a sound characteristic of coin insertion will be heard by a player.

Thus a player may insert an additional coin where it seems that the alloted time period is going to expire before the claw device is correctly positioned and it seems that the changes of recovering a prize will be greater if a new game is started from the current horizontal position of the claw device and carriage rather than from the home position.

The electronic control system shown schematically in FIG. 7 which provides the game operating sequence described above may be constructed on a signel printed circuit board contained within the game cabinet. Each of the three positioning motors and the claw actuating solenoid are connected to the control system by suitable connecting wires connected to appropriate positions on the circuit board.

In one preferred embodiment of the invention the X, Y and Z direction motors are driven by three similar circuits on the circuit board. Each of the circuits includes the respective switching relay which is used to reverse the direction of the associated motor by reversing the polarity of the drive voltage, a power transistor or other switching device which switches the power to a given motor on, and, in the case of the X and Y motors only, a variable voltage source or potentiometer which is used to adjust the speed at which the motor will operate.

Each motor is controlled by the controller via two logic lines, one for RUN/STOP and the other for DIRECTION. The RUN signal provides base current to the power transistor, for example a Darlington transistor, with the motor windings connected via the relay contacts as the collector load. The DIRECTION signal provides base current to a switching transistor which has the coil of the respective direction reversal relay as the collector load.

In one example of the invention the controller comprises suitable outputs from a programmable memory chip, such as a 2716 EPROM memory chip. The RUN/-STOP and DIRECTION signals for each motor are provided by six of the eight outputs from the memory chip under the control of suitable program instructions stored in the memory. The signals which operate the X and Y motors are gated through signal diodes to allow additional control signals to be provided from the player controlled joystick during the joystick enabled period. The joystick enable signal is provided by one of the two remaining outputs from the chip.

The stop button 22 is suitably wired to short the Z motor RUN signal to ground when depressed, turning the Z direction motor 130 off until the button is released. Pressing of the SLOW button 24 is arranged to ground the speed adjustment potentiometer, causing additional resistance to be included in the voltage divider which provides the drive voltage to the X and Y direction motors.

Figure 8:
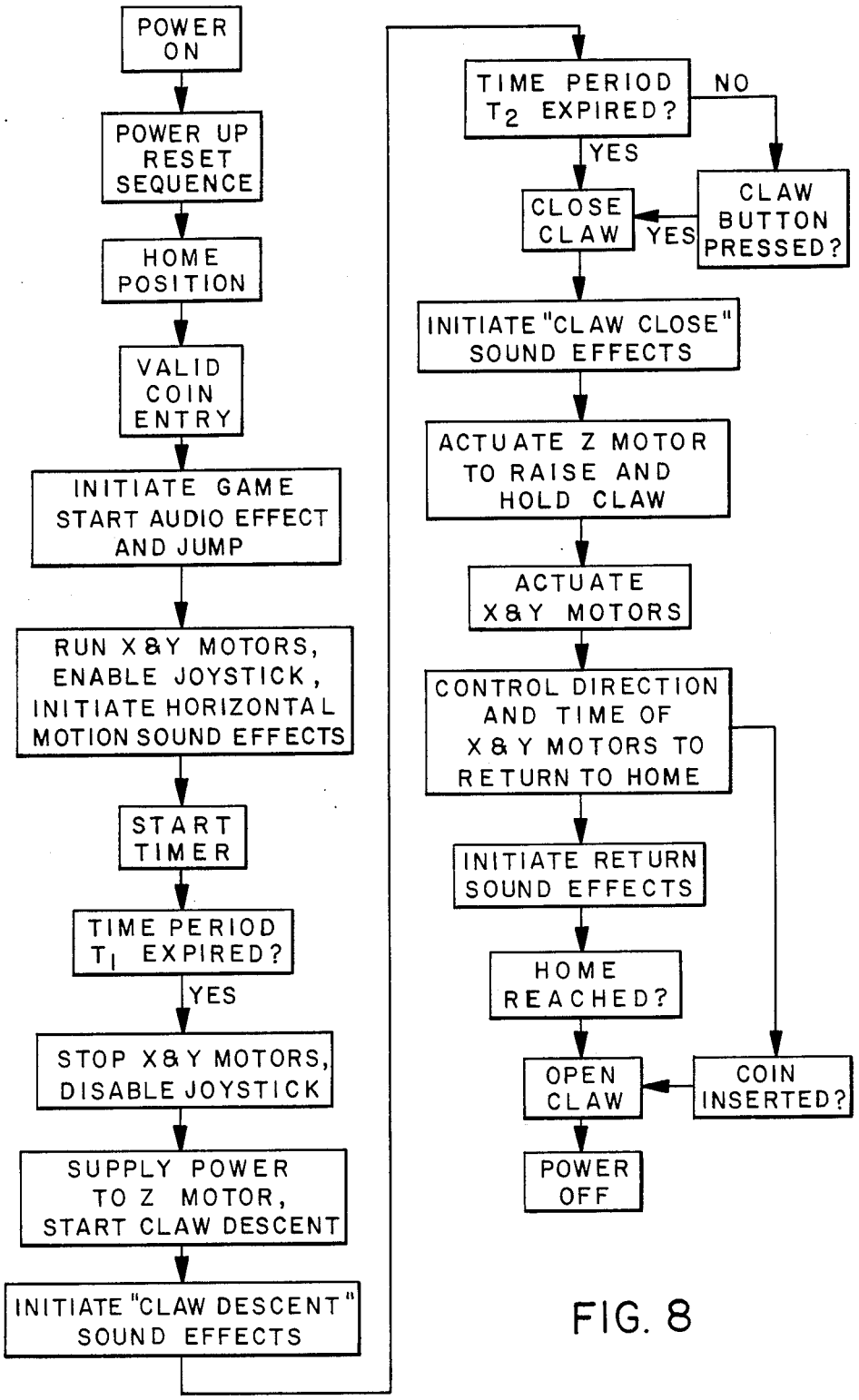
FIG. 8 is a flow diagram of the game sequence.

The EPROM is programmed to output the necessary control signals to produce the desired sequence of operation shown in FIG. 8 and described above under the control of a suitable program counter responsive to variable rate clock pulses controlling the timing sequence. The clock pulses may be generated by any suitable timers such as interconnected Schmitt trigger inverters. The EPROM or other suitable programmable controller is also suitably programmed to provide control signals selecting the tone output from the audio system according to the current status of the game sequence as indicated in FIG. 8. The audio system in one preferred embodiment comprises a voltage controlled oscillator with the controller arranged to control a variable voltage input to the oscillator to provide the desired tone output.

The chances of the player retrieving a prize are increased in this amusement device and success rates of fifty percent or greater are possible with experienced players. The device allows a greater degree of player control over the movement of the pick-up claw than previous machines of this general type. In the amusement device as described above the whole playing area is covered by the transport mechanism so that the claw can be moved to any chosen position within the playing area, which was often not possible in previous machines of this type. Since the claw is held rigidly against the carriage during all horizontal movement, swinging of the claw on its chain is prevented, so that the player is better able to see when the claw is positioned directly over a prize and the risk of a picked up prize being dropped is reduced. The player controls the position at which the claw stops and also controls the point at which the claw closes, so the player may stop and actuate the claw at the exact point that is most opportune for grasping a prize. This gives a much greater chance of prize retrieval and enhances the degree of player satisfaction, since the more skillful player will have a better change of retrieving a prize.

The X, Y and Z transport mechanisms are all provided by pulley drive assemblies connected to the respective drive motors via slipping clutches, making transportation of the carriage relatively smooth and vibration free with no abrupt switching off of the motors when the extreme limit of travel upwards or in either x or y direction is reached. Since each of the motors are automatically turned off at the expiry of predetermined time periods which are sufficient to return the claw to the home position from any point in the play area, the risks of one of the motors idling until it burns out as a result of switch failure are therefore eliminated.

Since the horizontal transport mechanism is mounted on the housing and only the vertical transport mechanism is mounted on the carriage, the weight of the carriage will be relatively low and it will move relatively freely and without significant vibration when transported in a horizontal plane.

Thus the amusement device of this invention has greater mobility and operates more smoothly than previous devices of this type, allows greater precision in positioning of the claw, and increases the chances of successful prize retrieval. This results in a game which is predominantly one of skill rather than chance.

The device or machine is in a modular form, allowing two or more such machines to be positioned side by side.

Although a preferred embodiment of the invention has been described above by way of example only, it will be understood by those skilled in the field that modifications may be made to the disclosed embodiment without departing from the scope of the invention, which is defined by the appended claims.

I claim:

1. An amusement device for retrieval of prize items by a player, comprising:

a housing having a floor over which prize items can be distributed and delivery means for delivering items to a player;

pick up means for picking up items from the floor of the housing;

a transport mechanism on which the pick up means is mounted, including horizontal transport means for transporting the pick up means in a horizontal plane above the floor area between a start position above the delivery means and a chosen horizontal location in the housing, and vertical transport means for moving the pick up means vertically up and down at a chosen horizontal location between a raised position and a lowered position at the level of underlying prize items;

control means for controlling operation of the horizontal and vertical transport mechanisms, the control means including player controlled means for control of the horizontal and vertical transport mechanisms; and the player controlled means including means for controlling the horizontal direction of travel of the pick up means, means for controlling the vertical position at which the pick up means is actuated to attempt to pick up a prize, and means for controlling actuation of the pick up means to attempt to pick up a prize, the control means including means for automatically returning the pick up means to the start position when the pick up means is actuated.

2. The device as claimed in claim 1, wherein the player controlled means includes means for controlling the speed of travel of the pick up device.

3. The device as claimed in claim 1, wherein the control means includes means for automatically actuating the vertical transport means after a predetermined time period has expired to move the pick up device downwards, and the player controlled means includes means for stopping the downward movement of the pick up device at a chosen vertical location.

4. The device as claimed in claim 1, wherein the housing has opposite side walls and front and rear walls defining the horizontal area of play, and the horizontal transport mechanism comprises and X direction drive means for controlling movement of the pick up device between the opposite side walls of the housing and Y direction drive means for controlling movement of the pick up device between the front and rear walls of the housing, each of the drive means including reversible motors for driving the pick up device in the respective directions, and the player controlled means including means for controlling the drive direction of the X and Y direction motors.

5. The device as claimed in claim 1, wherein the vertical transport mechanism includes a carriage, means for lowering the pick up device from the carriage, and means for holding the pick up device firmly against the carriage against movement relative to the carriage during horizontal travel of the pick up device and carriage.

6. The device as claimed in claim 5, wherein the means for lowering the pick up device comprises a reversible pulley drive mechanism mounted on the carriage and a line suspending the pick up device from the pulley drive mechanism, the pulley drive mechanism comprising a pulley and means for rotating the pulley in opposite directions under the control of the control means to unwind the line from the pulley to lower the pick up device and to wind the line onto the pulley to raise the pick up device until it is stopped and held against the carriage in the raised position, the horizontal transport mechanism comprising means for transporting the carriage and raised pick up device in the horizontal plane.

7. The device as claimed in claim 1, wherein the horizontal transport mechanism comprises a square frame rigidly mounted around the inner walls of the housing surrounding the playing area above the horizontal plane of transport, a first slide rod extending between and slidably mounted on a first two opposite sides of the frame and a second slide rod extending between the slidably mounted on the other two opposite sides of the frame and crossing over the first slide rod, means for slidably mounting the pick up device on the first and second slide rods at their cross over point such that movement of each of the rods causes the pick up device to slide on the other rod, first drive means for moving the first slide rod between said other two opposite sides of the frame, and second drive means for moving the second slide rod between the first two opposite sides of the frame.

8. The device as claimed in claim 7, wherein the first and second drive means each comprise reversible pulley drive mechanisms mounted on the inner walls of the housing above the play area.

9. The device as claimed in claim 1, wherein the player controlled means includes a lever for controlling the horizontal direction of travel of the pick up device, a stop button for controlling stopping of the pick up device during its descent towards the floor of the play area, a speed control button for controlling the speed of travel of the pick up device, and a pick up device button for actuating the pick up device to attempt to pick up a prize.

10. The device according to claim 9, wherein the control means includes means for detecting deposit of a predetermined coin in the device, means for enabling player control of the horizontal movement of the pick up means for a predetermined time period after deposit of a coin, means for cutting off player control of the horizontal movement after expiry of the predetermined time period, means for initiating descent of the pick up device after player control of horizontal movement has been cut off, and means for automatically returning the pick up means to the home position and releasing any picked up prize after the pick up device has been actuated.

11. The device as claimed in claim 1, further including an audio system for playing a predetermined sequence of sound effects during each game sequence, the control means further comprising means for controlling the audio system.

12. The device as claimed in claim 1, wherein the control means comprises a programmable controller and means for controlling the controller according to stored program instructions and player operation of the device to produce predetermined game sequence control signals for controlling operation of the transport means.

13. An amusement device comprising:

a housing having an inner play area with a floor over which prizes can be deposited and delivery means for delivery of prizes to a player;

pick up means for attempting to pick up prizes from the floor of the play area;

pick up actuator means for actuating the pick up means;

a transport mechanism on which the pick up means is mounted, including a horizontal transport means for transporting the pick up means in a horizontal plane over the entire floor area between a home position above the delivery means and a chosen horizontal location, and a vertical transport means for moving the pick up means vertically up and down at the chosen horizontal location between a raised position in the horizontal plane and a lowered position at the lever of underlying prizes;

control means for controlling operation of the horizontal and vertical transport means according to a predetermined game sequence, the control means including externally operated player control means for player control of the horizontal and vertical transport means during predetermined time periods in the game sequence;

the player control means comprising means for controlling the direction of travel of the pick up means in the horizontal plane during a first time period of the game sequence, means for controlling the vertical transport mechanism during a second time period of the game sequence to stop the pick up means at a chosen vertical location, and means for controlling actuation of the pick up means in attempting to pick up a prize.

14. The device as claimed in claim 13, wherein the control means further comprises means for automatically actuating the pick up device after expiry of a second predetermined time period after initiation of the descent of the pick up device.

15. An amusement device control system for controlling operation of a prize retrieval game in which a pick up device is operated by a player in an attempt to retrieve prizes within an enclosed play area, the system including:

means for initiating a predetermined game sequence on player deposit of a predetermined token;

means for enabling a player control means for controlling horizontal travel of the pick up device for a predetermined time period after initiation of the game sequence;

means for automatically lowering the pick up device towards a playing floor after expiry of the predetermined time period;

means for enabling a player to stop the pick up device at any chosen position while it is being lowered;

means for enabling a player to actuate the pick up device to attempt to pick up a prize during a second predetermined time period after lowering of the pick up device is initiated;

means for automatically actuating the pick up device after expiry of the second predetermined time period;

means for automatically returning the pick up device to a home position after automatic or player initiated actuation of the pick up device; and means for delivering any picked up prize to the player.

16. An amusement device, comprising:

a housing having opposite front and rear walls and opposite side walls defining an inner play area, the housing having a horizontal floor for distribution of prizes in the play area and a window on its front wall for player viewing of the play area;

the floor having an opening for delivery of prizes to a player;

a pick up device mounted in the play area comprising means for attempting to pick up prizes from the floor of the play area;

pick up device actuator means for actuation of the pick up device in attempts to pick up prizes;

a horizontal transport mechanism for transporting the pick up device in a horizontal plane above the play area floor, comprising a carriage on which the pick up device is suspended, X direction transport means for moving the carriage between the opposite side walls of the housing, and Y direction transport means for moving the carriage between the front and rear walls of the housing;

a vertical transport mechanism mounted on the carriage for lowering and raising the pick up device from the carriage between a raised position in which it is held firmly against the carriage and a lowered position in which it is at the level of prizes on the play area floor; and control means for controlling operation of the horizontal and vertical transport mechanism and the pick up device actuator means, the control means including player operable controls for controlling the direction of the X and Y direction transport means within a predetermined control period to transport the carriage to a chosen horizontal position, and for stopping the descent of the pick up device and controlling actuation of the pick up device.

17. The device as claimed in claim 16, wherein the X and Y transport means and the vertical transport mechanism each comprise a reversible drive motor, a pulley mechanism and clutch means for operatively connecting the motor to the pulley mechanism.

18. The device as claimed in claim 16, wherein the X and Y transport means comprise respective slide rods, one of the slide rods extending between the opposite side walls of the housing for sliding movement between the front and rear walls of the housing and the other rod extending between the front and rear walls of the housing for sliding movement between the side walls of the housing, and X and Y reversible drive means connected to the respective slide rods for driving them in opposite directions between the respective walls of the housing, the carriage being slidably mounted on each of the rods at the cross over point of the rods.

19. The device as claimed in claim 16, wherein the X and Y direction player operated control comprises a toggle lever movable in eight directions corresponding to eight horizontal directions of travel of the carriage, and switches associated with the lever for controlling the direction of the X and Y reversible drive means.

20. The device as claimed in claim 16, wherein the pick up device is a claw movable between an open position and a closed position in which any prize within the claw is gripped.

21. The device as claimed in claim 16, wherein the control means includes means for automatically operating the vertical drive mechanism each time the pick up device is actuated to raise the pick up device to the carriage and hold the pick up device against the carriage during transport of the carriage in the horizontal plane back to a home position.

22. An amusement device for retrieval of prize items by a player, comprising:

a housing having a floor over which prize items can be distributed and delivery means for delivering items to a player;

pick up means for picking up items from the floor of the housing;

a transport mechanism on which the pick up means is mounted, including horizontal transport means for transporting the pick up means in a horizontal plane above the floor area between a start position above the delivery means and a chosen horizontal location in the housing, and vertical transport means for moving the pick up device up and down at a chosen horizontal location between a raised position and a lowered position at the level of underlying prize items; and control means for controlling operation of the horizontal and vertical transport mechanisms, the control means including means for automatically actuating the vertical transport means after a predetermined time period has expired to move the pick up means downwards, and player controlled means for player control of the horizontal and vertical transport mechanisms including means for stopping the downward movement of the pick up means at a chosen vertical location.

23. An amusement device for retrieval of prize items by a player, comprising:

a housing having a floor over which prize items can be distributed and delivery means for delivering items to a player;

pick up means for picking up items from the floor of the housing;

a transport mechanism on which the pick up means is mounted, including horizontal transport means for transporting the pick up means in a horizontal plane above the floor area between a start position above the delivery means and a chosen horizontal location in the housing, and vertical transport means for moving the pick up device up and down at a chosen horizontal location between a raised position and a lowered position at the level of underlying prize items; and control means for controlling operation of the horizontal and vertical transport mechanisms, the control means including means for player control of the horizontal and vertical transport mechanisms;

the player controlled means including a lever for controlling the horizontal direction of travel of the pick up device, a stop button for controlling stopping of the pick up device during its descent towards the floor of the play area, a speed control button for controlling the speed of travel of the pick up device, and a pick up device button for actuating the pick up device to attempt to pick up a prize.

24. An amusement device, comprising:

a housing having opposite front and rear walls and opposite side walls defining an inner play area, the housing having a horizontal floor for distribution of prizes in the play area and a window on its front wall for player viewing of the play area;

the floor having an opening for delivery of prizes to a player;

a pick up device mounted in the play area comprising means for attempting to pick up prizes from the floor of the play area;

pick up device actuator means for actuation of the pick up device in attempts to pick up prizes;

a horizontal transport mechanism for transporting the pick up device in a horizontal plane above the play area floor, comprising a carriage on which the pick up device is suspended, X direction transport means for moving the carriage between the opposite side walls of the housing, and Y direction transport means for moving the carriage between the front and rear walls of the housing;

a vertical transport mechanism mounted on the carriage for lowering and raising the pick up device from the carriage between a raised position and a lowered position in which it is at the level of prizes on the play area floor;

the X and Y transport means and vertical transport mechanism each comprising a reversible drive motor, a pulley mechanism and clutch means for operatively connecting the motor to the pulley mechanism; and control means for controlling operation of the horizontal and vertical transport mechanism and the pick up device actuator means, the control means including player operable controls for controlling the direction of the X and Y direction transport means within a predetermined control period to transport the carriage to a chosen horizontal position, and for stopping the descent of the pick up device and controlling actuation of the pick up device.

* * * * *